United States Patent [19]

Nogi et al.

[11] 4,256,934

[45] Mar. 17, 1981

[54] DISCONNECTING SWITCH ARRANGEMENT

[75] Inventors: Teiji Nogi, Tokyo; Takao Yasuda, Numazu, both of Japan

[73] Assignee: Kabushiki Kaisha Meidensha, Tokyo, Japan

[21] Appl. No.: 62,141

[22] Filed: Jul. 30, 1979

[30] Foreign Application Priority Data

Aug. 4, 1978 [JP] Japan ..... 53-107853[U]
Aug. 10, 1978 [JP] Japan ..... 53-97564

[51] Int. Cl.[3] ..... H01H 31/00
[52] U.S. Cl. ..... 200/48 R; 200/48 SB
[58] Field of Search ..... 200/48 R, 48 A, 48 SB, 200/48 CB, 153 G

[56] References Cited

U.S. PATENT DOCUMENTS

| | | | |
|---|---|---|---|
| 2,954,450 | 9/1960 | Mikos | 200/48 R |
| 3,801,768 | 4/1974 | Meyer | 200/48 R |
| 3,886,336 | 5/1975 | Boersma et al. | 200/48 R |
| 4,012,609 | 3/1977 | Cleaveland | 200/48 R |
| 4,049,933 | 9/1977 | Lovett | 200/48 R |

*Primary Examiner*—Willis Little
*Attorney, Agent, or Firm*—J. Harold Nissen

[57] ABSTRACT

A disconnecting switch arrangement for a high voltage disconnecting switch equipped with an earthing device for use particularly in a metal clad insulated substation. The arrangement comprising a disconnecting unit, an earthing unit and an actuating unit for actuating the disconnecting unit and the earthing unit. The disconnecting unit comprises a stationary contact member, a common stationary contact member at a standard spacing from the stationary contact member and a common movable contact member for disconnecting from and connecting with the stationary contact member and the common stationary contact member and is moved in a circular motion by the actuating unit. The earthing unit is comprised by an earthing contact member, the common stationary contact member and the common movable contact member each of which is commonly used with the disconnecting unit.

10 Claims, 14 Drawing Figures

DISCONNECTING SWITCH ARRANGEMENT

The present invention relates to a disconnecting switch arrangement, and more particularly to a high voltage disconnecting switch equipped with an earthing device for use particularly in a metal clad insulated substation in an electric power system.

In recent years, the spot network system has been developed for electric power systems. In the spot network system, metal insulated substations are inevitable in order to reduce the space for installing the substation. A disconnecting switch is used to disconnect the busbars of a power line from electrical equipment after the current from the power line is interrupted by some other switching device such as, for example, a vacuum interrupter. Accordingly, a number of disconnecting switches are used in a metal clad insulated substation in a spot network system together with the other electrical equipment such as circuit breakers, and transformers. Further, a number of earthing devices are required in a high voltage metal clad insulated substation in order to ground the electrical equipment after the busbars are disconnected from the electrical equipment by the circuit breakers and disconnecting switches.

In the prior art, a disconnecting switch and an earthing device are normally installed individually in a metal clad insulated substation, and such a separate disconnecting switch and earthing device must allow for a large radius of rotation of the contact blades. Accordingly, in such installations, the relative spacing of the high voltage apparatus and conductors, irrespective of the exact geometric shape of the high voltage components of the system, must be equal to at least the theoretical minimum flash over distance between points, because the electrical fields are extremely inhomogeneous. The waste of space is therefore considerable because in most of the space provided, the field strengths are actually very low. Such a conventional metal clad insulated substation, therefore, is large and expensive.

In one use, the disconnecting switch is employed to disconnect an excitation current of a primary winding of a transformer. In this case, a secondary current of the transformer is interrupted by a circuit breaker such as a vacuum interrupter for interrupting the load current. After the secondary winding of the transformer is disconnected from a load line, the excitation current, however, must be interrupted by the disconnecting switch. It is, however, undesirable to interrupt the current using a conventional disconnecting switch, because a complicated and castle operating unit is required to obtain a high speed disconnection, and a wide disconnecting area is necessary for making the disconnecting distance so long.

It is, therefore, an object of the present invention to provide an improved high voltage disconnecting switch arrangement which requires comparatively little space in the direction of the switching movement so that in multi-phase installations the disconnecting switch and the earthing device can be arranged in a very small space.

It is a further object of the present invention to provide a disconnecting switch arrangement suitable for underground use which is reliable, economical and easily operated.

It is still another object of the present invention to provide a disconnecting switch arrangement as described above which is capable of modifications and adaptations, particularly for being used to interrupt a relatively low current, and including an arcing contact member.

With above objects in view the invention provides basically for a disconnecting switch arrangement for disconnecting a busbar from an electrical machine and for earthing the electrical machine, comprising, in combination, at least one disconnecting unit including a stationary contact member having a contact portion and a common stationary contact member positioned spaced apart a constant distance from said stationary contact member and connected to said electrical machine and a common movable contact member for connecting stationary contact member, at least one earthing unit for grounding said electrical machine and including an earthing contact member, said common stationary contact member and said common movable contact member for connecting the common stationary contact member and the earthing contact member, and an actuating unit for operating said common movable contact member so as to be alternately connected electrically between said stationary contact member and said common movable contact member of the disconnecting unit and between said common movable contact member and said earthing contact member of the earthing unit.

The novel features which characterize the invention are set forth in particular in the appended claims. The invention itself, however, both as to its construction and its method of operation together with additional objects and advantages thereof, will be best understood from the following description of specific embodiments when read in connection with the accompanying drawings, in which:

FIG. 1 is a diagram of an example of a substation in which a disconnecting switch arrangement is used, FIG. 2 is a sectional side view showing one phase of a three-phase high voltage disconnecting switch arrangement in accordance with the present invention, FIG. 3 is a sectional elevation of a disconnecting switch arrangement along line III—III of FIG. 2, FIG. 4 is a sectional side view of a disconnecting unit and an earthing unit forming a part of the arrangement in accordance with the present invention, taken along line IV—IV of FIG. 3, FIG. 5 is a side view of a disconnecting switch arrangement in accordance with the present invention, looking along arrow V in FIG. 3, FIG. 6 is a side view of a supporting member forming a part of an actuating unit in a disconnecting switch arrangement according to the present invention, FIGS. 7 to 13 are side views corresponding to FIG. 4, of modifications of the present invention each of which shows the operation of a disconnecting unit equipped with an arcing contact member, and FIG. 14 is a sectional elevation of a disconnecting unit and an earthing unit forming a part of the arrangement in accordance with the present invention, the section being taken along line XIV—XIV.

DESCRIPTION OF THE PREFERRED EMBODIMENTS

Figure 1:
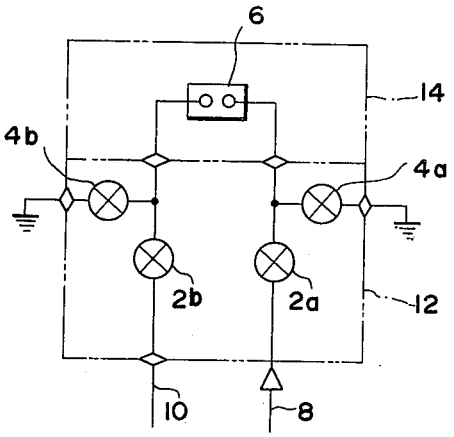

Referring to FIG. 1 of the drawings, there is shown a substation of an electric power system, which employs a high voltage disconnecting switch arrangement according to the present invention. The disconnecting switch arrangement comprises, substantially, a first disconnecting unit 2*a* which is electrically connected to a power line 8 and an interrupting unit 6, a first earthing unit 4*a* for grounding the line to an item of electrical equipment such as the interrupting unit 6 after the power line 8 is disconnected from the interrupting unit 6 by the first disconnecting unit 2*a*, a second disconnecting unit 2*b* which is electrically connected between the interrupting unit 6 and a load line 10, and a second earthing unit 4*b* for grounding the line part of the interrupting unit 6 after the interrupting unit 6 is disconnected from the load line 10 by the second disconnecting unit 4*b*.

The disconnecting units 2*a* and 2*b* and the earthing units 4*a* and 4*b* are, in this case, contained in a first tank 12 which is filled with insulating oil. The interrupting unit 6 is contained a second tank 14.

Certain words are used in this specification indicating direction, relative position, and the like. Such words are used only as seen in the particular drawings of embodiments, and the parts so described may, in actual use, have different directions, relative positions, and the like. Examples of such words are "upper", "lower", "vertical" "horizontal".

Figure 2:
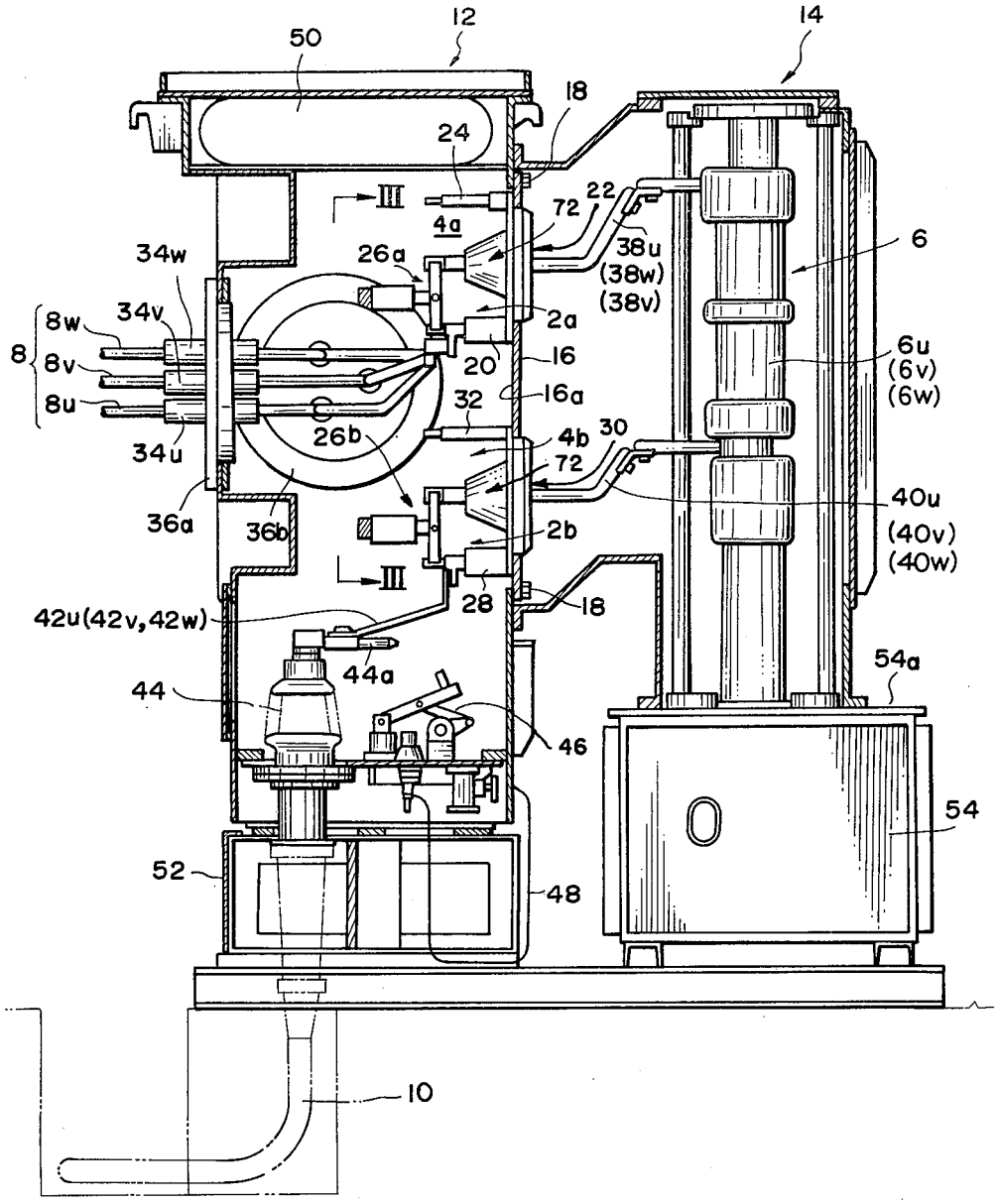

FIG. 2 shows the mechanical construction of the disconnecting switch arrangement of FIG. 1. As is shown in FIG. 2, an adapter plate 16 is fixed hermetically and liquid-tightly to the first tank 12 by bolts 18. On the inner surface 16*a* is provided the first disconnecting unit 2*a*, the first earthing unit 4*a*, the second disconnecting unit 2*b* and the second earthing unit 4*b*.

The first disconnecting unit 2*a* comprises a stationary contact member 20 mounted on the inner surface 16*a* of the adapter plate 16, a common stationary contact member 22 at a standard spacing from the stationary contact member 20 and a common movable contact member 26*a* which is described in more detail below. The first earthing unit 4*a* comprises the common stationary contact member 22 and an earthed contact member 24 at the same standard spacing from the common stationary contact member 22 as the stationary contact member 20, and the common movable contact member 26*a*.

The second disconnecting unit 2*b* comprises a stationary contact member 28 mounted on the inner surface 16*a* of the adaptor plate 16 in the same way as the stationary contact member 20 of the first disconnecting unit 2*a*, a common stationary contact member 30 at the standard spacing from the stationary contact member 28, and a common movable contact member 26*b*. The second earthing unit 4*b* comprises the common stationary contact member 30, an earthed contact member 32 which is mounted on the inner surface 16*a* of the adaptor plate 16 at the standard spacing from the common stationary contact member 30, and the common movable contact member 26*b*.

Figure 3:
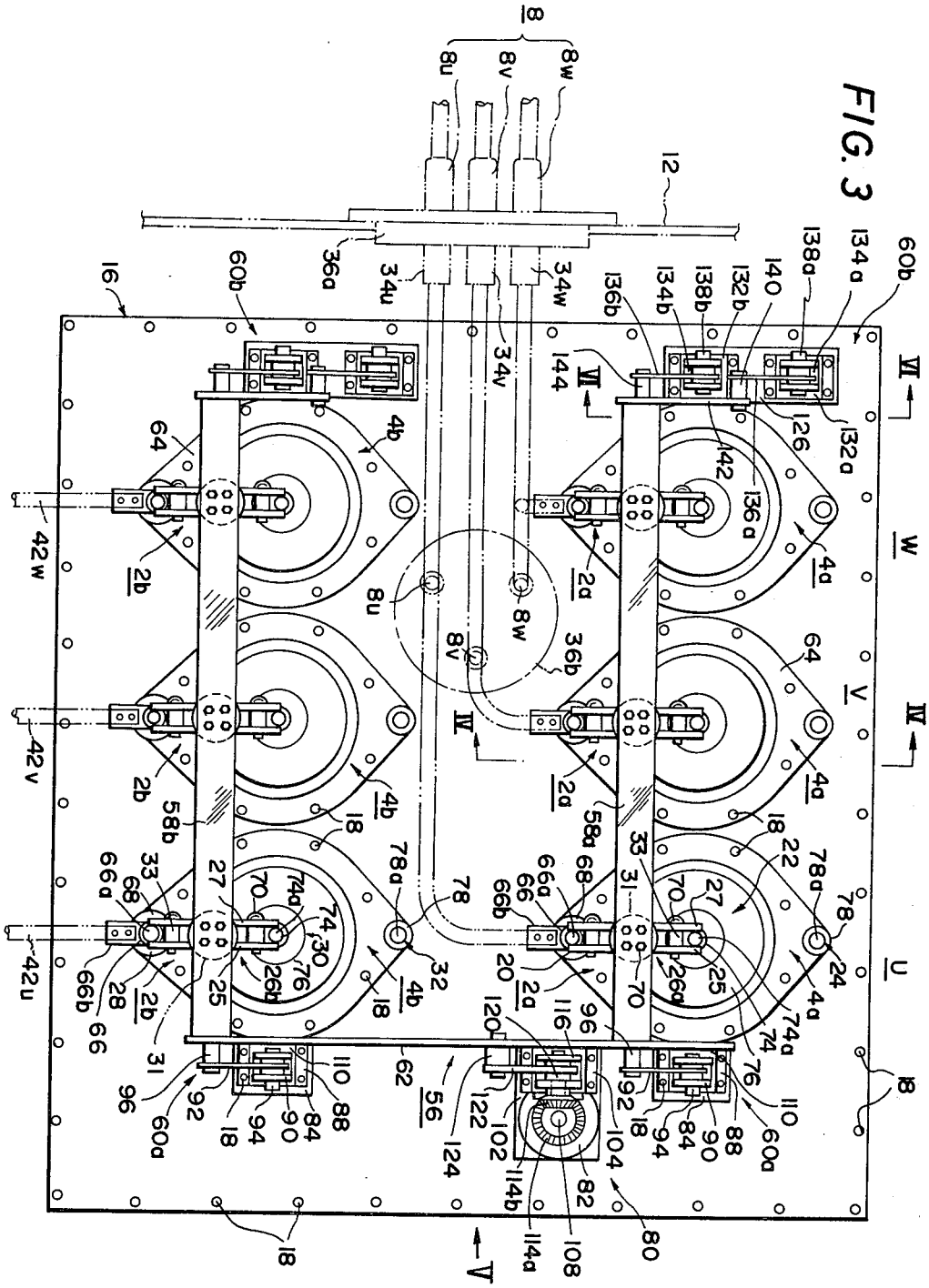

Three pairs each of the disconnecting units 2*a*, 2*b* and the earthing units 4*a*, 4*b* are provided, in this embodiment, to form a three-phase circuit which consists of an U-phase, a V-phase and a W-phase, as is shown in FIG. 3.

As illustrated in FIG. 2, the interrupting unit 6 consists of three interrupting devices in the form of vacuum interrupters 6*u*, 6*v* and 6*w*, but vacuum interrupter 6*v* and 6*w* are not visible in the drawing.

As is shown in FIGS. 2 and 3, the stationary contact member 20 of the disconnecting units 2*a* for the U, V and W phases are connected to busbars 8*u*, 8*v* and 8*w* respectively of the power line 8. The busbars 8*u*, 8*v* and 8*w* pass through cable heads 34*u*, 34*v* and 34*w* which are secured to the first tank 12 by an insulating board 36*a*. The busbars 36*u*, 36*v* and 36*w* are turned perpendicularly to the busbars 8*u*, 8*v* and 8*w*, and pass through an insulating spacer 36*b* to connect to another power line (not shown in the drawing). The common stationary contact member 22 is electrically connected to the stationary contact side of the interrupting member 6 which is in this embodiment in the form of the vacuum interrupters 6*u*, 6*v* and 6*w* by connecting conductors 38*u*, 38*v* and 38*w*. The connecting conductors 38*v* and 38*w* are not shown in the drawings.

In the second disconnecting unit 2*b*, each of the common stationary contact members 30 is connected to the switched side of the vacuum interrupters 6*u*, 6*v* and 6*w* by way of connecting conductors 40*u*, 40*v* and 40*w*. Conductors 40*v* and 40*w* are not illustrated in the drawing. Furthermore, each of the stationary contact members 28 is connected to the load line 10 by way of conductors 42*u*, 42*v* and 42*w* (see FIG. 3), through a connector head 44. An additional earthing unit 46 earthed by a lead 48 is provided so as to be switched on and off between a fixed contact 44*a* mounted on the connector head 44. A conservator 50 is provided at an upper portion of the first tank 12. The first tank 12 is secured on a fixing base 52. The second tank 14 enclosing the interrupting unit 6 is mounted on a base plate 54*a* which forms part of an operating unit 54.

As is shown in FIG. 3, an actuating unit 56 is provided to operate the common movable contact units 26*a* and 26*b*. The actuating unit 56 includes a first operating rod 58*a* to which are mounted the common stationary contact members 24*a* for the U, V and W phases, and a second operating rod 58*b* to which are mounted the common stationary contact members 24*b* for the U, V and W phases in the same manner as the first operating rod 58*a*. The actuating unit 56 further includes first supporting members 60*a* pivotally supporting one end portion of the operating rods 58*a* and 58*b* and second supporting members 60*b* pivotally supporting the other ends of the operating rods 58*a* and 58*b* and a drive means 80 for actuating the common movable members 26*a* and 26*b*, through a connecting plate 62.

Figure 4:
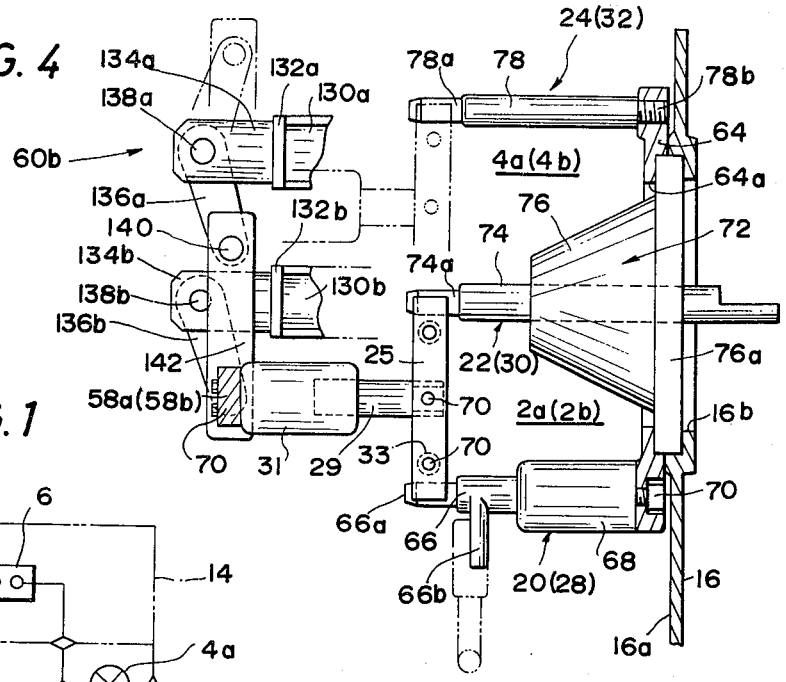

FIG. 4 shows a specific structure for the disconnecting units 2*a* and 2*b* and the earthing units 4*a* and 4*b*. As is best shown in FIGS. 3 and 4, a circular hole 16*b* is formed in the adaptor plate 16 and a conductive mounting plate 64 having a circular hole 64*a* is fastened to the adaptor plate 16 by a plurality of fastening bolts 18 as shown in FIG. 3. An insulated conductor assembly 72 is secured on the adaptor plate 16 to form the common stationary contact member 22. The insulated electrical conductor 72 is formed of an elongated electrical conductor 74 of fixed length and surrounded by a cone-shaped insulator 76. Both ends of the conductor 74 are exposed for connecting to other conductors. One end of the conductor 74 is formed as a contact portion 74*a* which has a smaller diameter and is adapted to be connected with and disconnected from the common movable contact member 26*a* or 26*b*, and the other end portion is connected to the conductor 38*u*, 38*v* or 38*w* to be connected to the unswitched contact side of the vacuum interrupter 6*u*, 6*v* or 6*w*. The cone-shaped insulator 76 is mounted on the adaptor plate 16 by holding a flange portion 76*a* between the adaptor plate 16 and the conductive fastening plate 64. An insulated conductor assembly 64 is formed with an elongated conductor 66 of fixed length with a circumferential insulating layer 68. One end of the conductor 66 projects from the insulator 68, and has an end portion formed with a smaller diameter a contact portion 66*a* which is connected to and disconnected from the common movable contact member 26*a* or 26*b*. A connector portion 66*b* is also provided at the same end of the conductor 66. The insulator 68 of the insulated conductor assembly 66 is secured by a screw 70 so as to construct the stationary contact member, at the current spacing from the conductor 72 of the common stationary contact member 22. An earthing conductor 78 is spaced at the same standard distance from the insulated electrical conductor 72 of the common stationary contact member 22 and is aligned with respect to the insulated conductor 66 of the stationary contact member 20 and the insulated conductor 72 of the common stationary contact member 22. One end of the earthing conductor 78 is formed as a smaller diameter contact portion 78*a* to be connected to and disconnected from the common movable contact member 26*a* or 26*b*, and the other end of the electric conductor 78 is formed as a threaded portion 78*b*. To construct the earthing member 24, the earthing conductor 78 is fixed to the conductive plate 64 which is grounded by suitable means. The common movable contact member 26*a* or 26*b* is formed of a pair of contact blades 25 and 27, a connecting rod 29 and an insulating member 31. At portions near each end, the blades 25 and 27 are separated by spacers 33 and held together by screws 70. One end of the connecting rod 29 is embedded in one end portion of the insulating member 31. The other end portion of the connecting rod 29 has a flattened portion which is inserted into the gap formed between the contact blades 25 and 27, and is fastened to the contact blades 25 and 27 by a screw 70, at a central portion of the contact blades 25 and 27. A base portion of the insulating material 31 is fixed to the operating rod 58*a* or 58*b* of the actuating unit 56 in order to connect the common movable contact member 26*a* or 26*b* respectively with the actuating unit 56.

Figure 5:
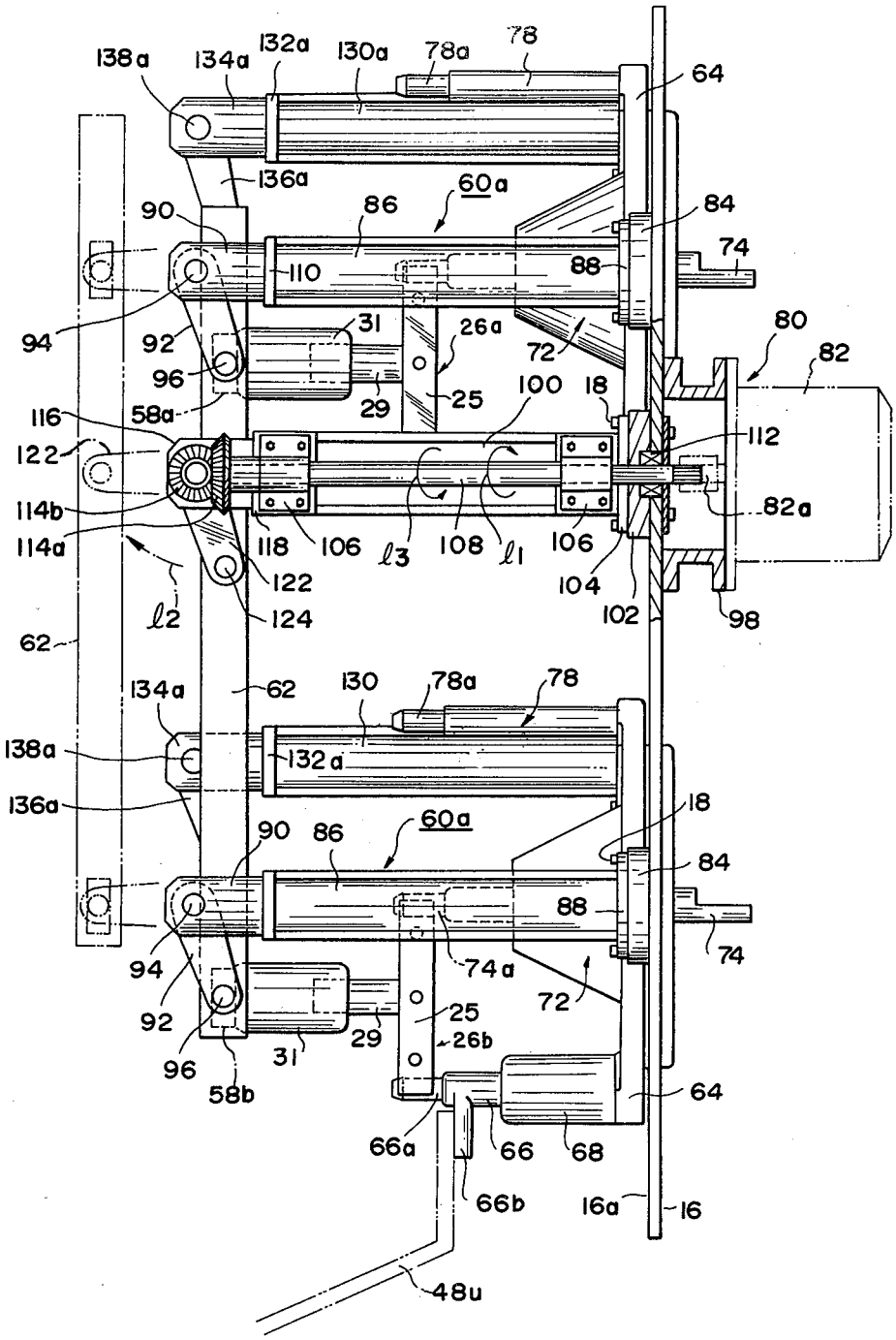

FIGS. 3 and 5 show the actuating unit 56 of a disconnecting switch arrangement according to the present invention. As described above the actuating unit 56 comprises the actuating rods 58*a* and 58*b* to which are mounted the common movable contact members 26*a* and 26*b*, first supporting members 60*a* and second supporting members 60*b* which support and pivotably connect to the actuating rods 58*a* and 58*b*, and the drive means 80.

As is shown in FIGS. 3 and 5, a pair of first supporting members 60*a* are mounted on the inner side 16*a* of the adaptor plate 16, spaced apart at a given distance from each and in alignment with each other. The drive means 80 is also mounted on the adaptor plate 16 in an intermediate position between the first supporting members 60*a*. In the first supporting member 60*a*, a base plate 84 is attached to the adaptor plate 16 by suitable fastening means, and a support 86 is fixed to the base plate 84 by a fixing plate 88 and bolts 18. A U-shaped trunnion 90 is mounted on the support 86. A link 92 is pivotably connected to the trunnion 90 by a pin 94, and the link 92 is pivotably engaged with the actuating arm 62 by a connecting pin 96. In the drive means 80, an electric motor 82 is mounted on the adaptor plate 16 by means of an H-shaped spacer 98. A support such as a U-shaped channel member 100 is fixed to the adaptor plate 16 by a base plate 102 and a fastening flange 104 and bolts 18. Thus, the base plate 102 is fixed to the inner side 16*a* of the adaptor plate 16. The fastening plate 102 is fastened to one end of the U-shaped channel member 100 by welding, and the fastening flange 104 is fixed to the base plate 102 by bolts 18. Bearings 106 are mounted on both end portions of the channel member 100. A driving shaft 108 is supported by the bearings 110 so that one end portion passes through the fastening plate 104, the base plate and an oil sealing 112, and the extreme end of the driving shaft 102 is coupled with the shaft 82*a* of the motor 82. The other end of the driving shaft 108 supports a driving bevel gear 114*a*. As shown in FIGS. 3 and 5, a U-shaped trunnion 116 is mounted on the channel member 100 by a plate 118. A shaft 120 supporting a driven bevel gear 114*b* which meshes with the driving bevel gear 114*a* is mounted rotatably in the trunnion 116 so as to be perpendicular to the driving shaft 108. One end of a lever 122 is fixedly attached to the rotating shaft 120, and the other end is pivotably connected to an intermediate portion of the actuating rod 62 by a pin 124.

Figure 6:
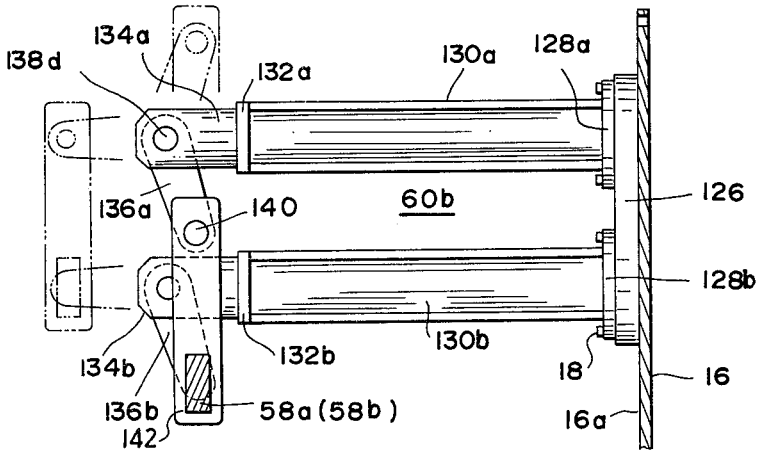

As best seen in FIG. 6, for each of the second supporting members 60*b*, a base plate 126 is secured to the inner surface 16*a* of the adaptor plate 16 by welding or similar means. A pair of supports in the form of channel members 130*a* and 130*b* are secured to the base plate 126 by fixing plates 128*a* and 128*b* which are fastened to one end of channel members 130*a* and 130*b*, respectively, by bolts 18. Fastening plates 132*a* and 132*b* are secured to the other end of channel members 130*a* and 130*b*, respectively. Furthermore, a U-shaped trunnions 134*a* and 134*b* are fastened to fastening plates 132*a* and 132*b*. A lever 136*a* is pivotably connected to the trunnion 134*a* by a pin 138*a*. An end portion of the lever 136*a* is pivotably connected to a connecting plate 142 by means of a connecting pin 140. One end of a lever 136*b* is rotatably mounted to the trunnion 134*b* by a pin 138*b*. The other end portion of the lever 136*b* is rotatably connected by a fixed pin 144 to the end of the actuating rod 58*a* or 58*b*.

In operation, each of the busbars 8*u*, 8*v* and 8*w* of the power line 8 is connected to a first disconnecting member 2*a* and the first disconnecting member 2*a* is connected to the interrupting unit 6. The interrupting member 6 is engaged with the second disconnecting member 2*b*, and the second disconnecting member 2*b* is connected to the load cable 10 through the connector head 44. Accordingly, as illustrated in FIG. 2, the busbar 8*u*, 8*v* or 8*w* is electrically connected to the load cable 10 by way of the first disconnecting unit 2*a*, the interrupting unit 6 and the second disconnecting unit 2*b*.

In order to disconnect the load cable 10 from the busbars 8*u*, 8*v* and 8*w*, the interrupting unit 6 is actuated initially to interrupt the current flowing from the power line 8 to the load cable 10. After the actuation of the interrupting unit 6, the first and second disconnecting units 2*a* and 2*b* must be actuated to disconnect the load cable 10 from the busbar 8*u*, 8*v* and 8*w* of the power line 8. After the power line 8 is disconnected by the disconnecting units 2*a* and 2*b* from the load cable 10, the interrupters must be grounded in order to discharge any electric charge stored in them. In a disconnecting switch arrangement in accordance with the present invention, the disconnecting units 2*a* and 2*b* are interlocked with the earthing unit 4*a* and 4*b* by the operation of the common movable contact members 26*a* and 26*b*, which are actuated by the actuating unit 56. When the power line 8 is electrically connected to the load cable 10, as is shown in FIGS. 2 and 3, the common movable contact member 26*a* connects the stationary contact member 20 to the common stationary member 22 is the first disconnecting unit 2*a* and, in the same manner, the common movable contact member 26*b* connects the stationary contact member 28 to the common stationary contact member 30.

In this condition, when the driving shaft of the actuating unit 56 is rotated by the motor 82 in the clockwise direction as seen from the right in FIG. 5, (arrow $l_1$), the driving bevel gear 114*a* turns the driven bevel gear 114*b* in the clockwise direction as indicated by arrow $l_2$, and thereby the lever 122 attached to the shaft 120 of the driven bevel gear 114*b* rotates in the same direction about the shaft of the driven gear 114*b*. The rotation of the lever 120 is transmitted to the connecting lever 62 and thereby the connecting lever 62 being pivotably supported by the first supporting members 62*a* and the second supporting members 62*b* by means of the levers 92, 138*a* and 138*b*, moves through a semicircular path as indicated by a broken line. As the movement of the connecting rod 62, the operating rods 58*a* and 58*b* are moved together with the connecting rod 62. The movement of the operating rods 58*a* and 58*b* makes the contact blades 25 and 27 move in the same direction so that the contact blades 25 and 27 disconnect from the disconnecting members 2*a*, 2*b* and connect to the earthing members 4*a*, 4*b* as shown by a broken line in FIGS. 4 and 5.

In the earthed and disconnected condition, the connection operation can be performed by the reverse operation to the disconnecting operation described above. Namely, the motor is rotated in an anti-clockwise direction, turning the driving shaft 102 in an anti-clockwise direction as seen from the right in FIG. 5 (arrow $l_3$), and thereby the driving bevel gear 114*a* drives the driven bevel gear 114*b* in the anti-clockwise direction. The rotation of the driven gear 114*b* is transmitted to the common movable contact members 26*a* and 26*b* by the link 122, the connecting arm 62 and the operating rods 58*a* and 58*b* to perform the semicircular motion. By this movement of the common movable contact member 26*a* and 26*b* in the anti-clockwise direction, the common movable contact members 26*a* and 26*b* are isolated from the earthing members 4*a* and 4*b*, respectively and thereafter are connected to the disconnecting units 2*a* and 2*b*, respectively.

According to the disconnecting switch arrangement described above, because of the construction of the movable contact members 26*a* and 26*b* driven by the rotating lever 122, the range of travel of the movable contact members can be made relatively small, and therefore the equipment can be used as a compact alternating current device. Furthermore, since the movable contact members, stationary contact members and drive means of the disconnecting units and earthing or grounding units are used in common an interlock between the disconnecting unit and the earthing or grounding unit is intrinsic. There is thus no need to provide such an interlock separately, so that part are saved and the construction is siplified.

FIGS. 7 to 14 show a modification of the disconnecting switched arrangement in accordance with the present invention. In the modified form of the disconnecting switch arrangement, there is provided an arcing member contact 150 for interrupting the arc current which flows between the common movable contact member 26*a* or 26*b* and the stationary contact member 20 or 28 or the common stationary contact member 22 or 30 of the disconnecting unit 2*a* or 2*b*, if the disconnecting unit 2*a* or 2*b* is used, for example, to interrupt an energizing current of a transformer (not shown in the drawing).

As shown in FIGS. 7 to 14, the arcing contact member 150 includes an arcing contact means which consists of a long and slender conducting plate 152, a link 154 which connects a base portion of the conducting plate plate 152 to a common movable contact member 26*a* or 26*b*, a contact driving means for driving the electric conductive plate 152 and a disconnecting delaying means for delaying the electrical disconnection of the common movable contact member 26*a* or 26*b* from the stationary contact members 20 or 28 and 22 or 30. The contact driving means includes a spring 162 which is interposed between the conducting plate 152 and a projection 168 formed on the common movable contact member 26*a* or 26*b*. Thus, one end of the spring 164 is engaged with the conducting plate 152 by a fixed pin 166, and other end is engaged with a projection 168 on the connecting rod 29. A base portion of the contact plate 152 is pivotably connected to an end portion of the lever 154 by an engaging pin 160, and a base portion of the lever 154 by a pin 158. The disconnection delaying means includes a roller 156 provided between the plate 152 and the lever 154 by the pin 160. The disconnection delaying means further comprises a conductor 66 of the stationary contact member 20 or 28 longer than conductor 74, a groove 176 formed in a contact portion 74*a* of the conductor 74, an engaging pin 170 which is embedded in the contacting portion 74*a*, an axial recess 172 provided on the contacting portion 66*a* of the conductor 66 and a groove 174 provided on the surface of an intermediate portion of the conductor 66.

Operation will now be described with reference to the disconnecting switch arrangement as constructed above.

Figure 7:
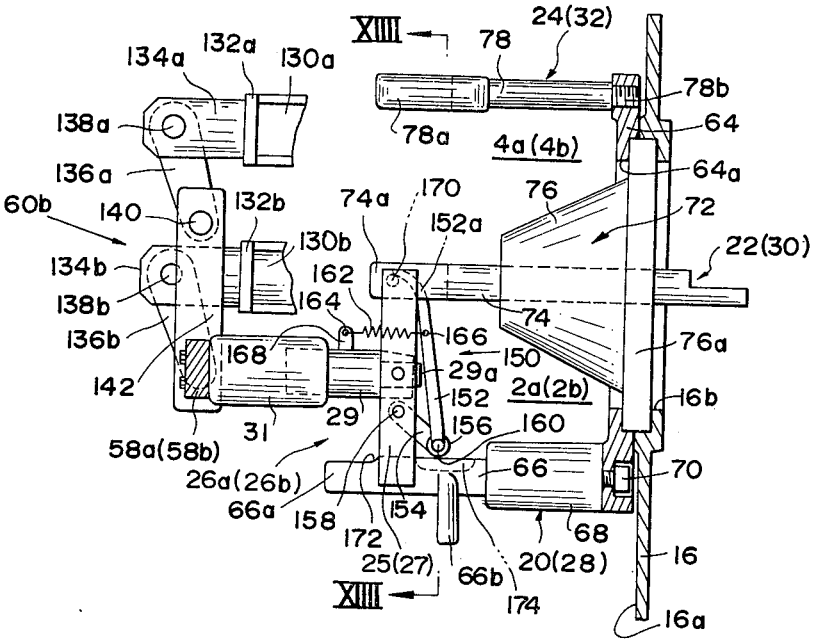

FIG. 7 shows a connecting condition of a disconnecting unit 2*a* or 2*b*. In the connecting condition of the disconnecting units 2*a* and 2*b*, the conductor 66 of the stationary contact member 20 or 28 is connected to the conductor 74 of the common stationary contact member 22 or 30 by means of the contact blades 25 and 27 of the common movable contact member 26*a* or 26*b*. In this case, the arcing contact member 150 connects electrically between conductors 76 and 74. In this case, the curved end portion 152*a* of the arcing contact 152 is positioned in the groove 176 of the contact portion 74*a* of the conductor 74 and engaged with the engaging pin 170. The roller 156 engages in the recess 174 in the conductor 66.

Figure 8:
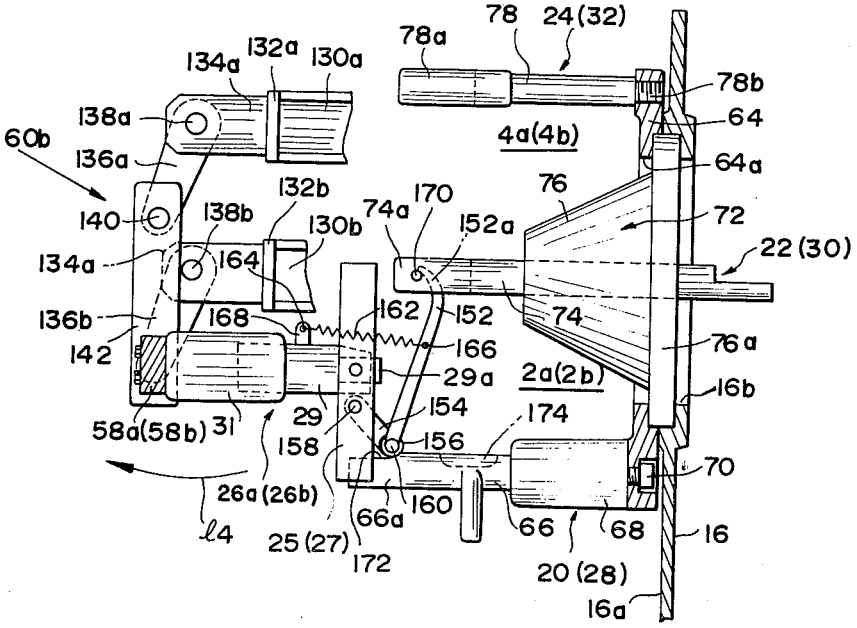

As the common movable contact member 26*a* or 26*b* is moved in the direction indicated by arrow $l_4$, the the movable contact blade is separated from the contact portion 74*a* of the conductor 74 while the roller 156 slides over the recess 174 and drops in the recess 172, and the common contact blade 25 or 27 is still engaged with the contacting portion 66*a* of the conductor 66, as is shown in FIG. 8.

Figure 9:
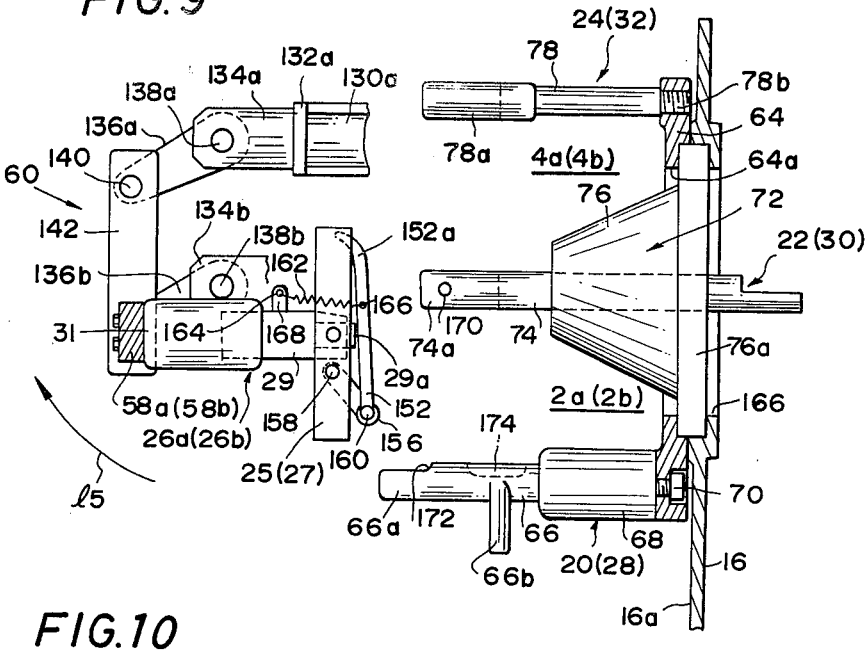

In this case, the spring is gradually stretched and the excitation current of the transformer flows through the arcing blade 152, as shown in FIG. 8. As the common movable contact blade 25 or 27 moves further, when the roller 156 is located at the extreme end of the contacting portion 66*a*, the end portion 152*a* disengages from the engaging pin 170 and thereby the arcing contact 152 is swiftly rotated about the roller 156 in the counter clockwise direction. Now the arcing contact blade 25 or 27 is fully separated from the contacting portion 74*a* so that no arc is generated therebetween. The common movable contact member is fully separated from the both of the stationary contact member 20 or 28 and the common stationary contact member 22 or 30, as shown in FIG. 9. In this situation the common movable contact member 26*a* or 26*b* is further moved through a semicircular path in clockwise direction as shown by an arrow $l_5$, the common movable blade engages with the contacting portion 74*a* of the conductor 74 and the earthed conductor 78 to ground the equipment, as shown in FIG. 10.

Figure 10:
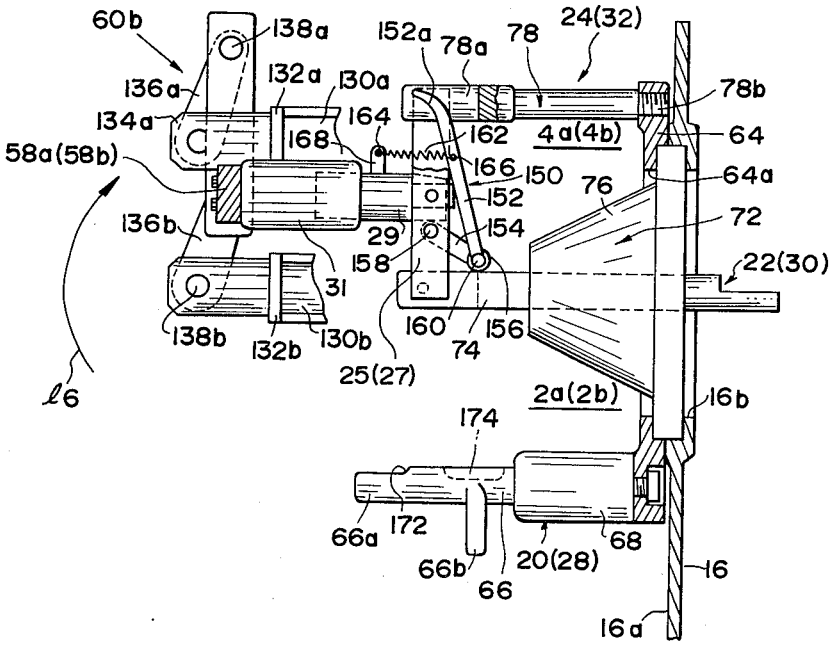
Figure 11:
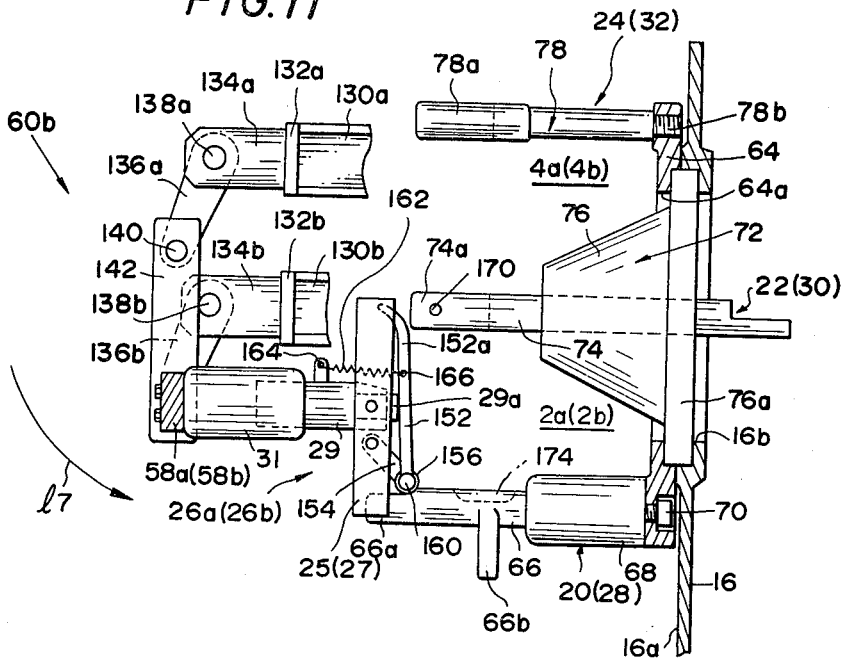
Figure 12:
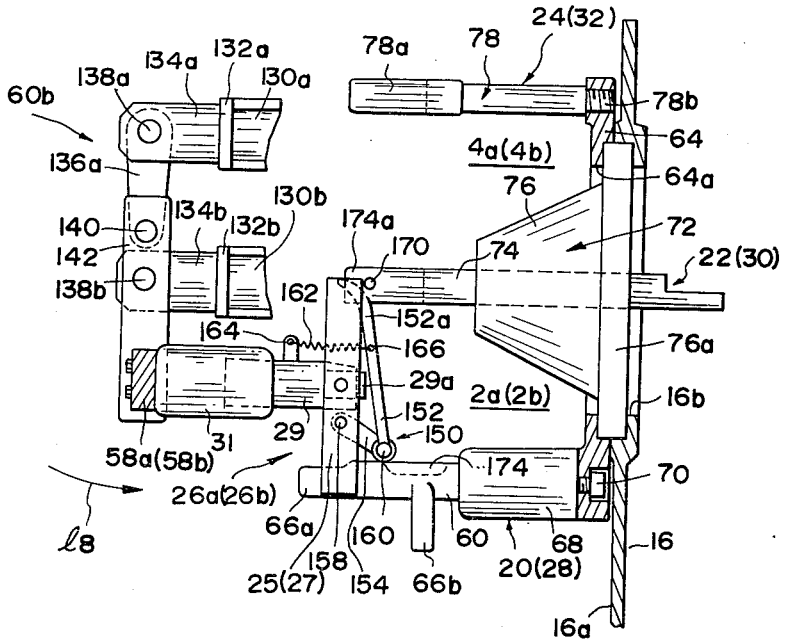
Figure 13:
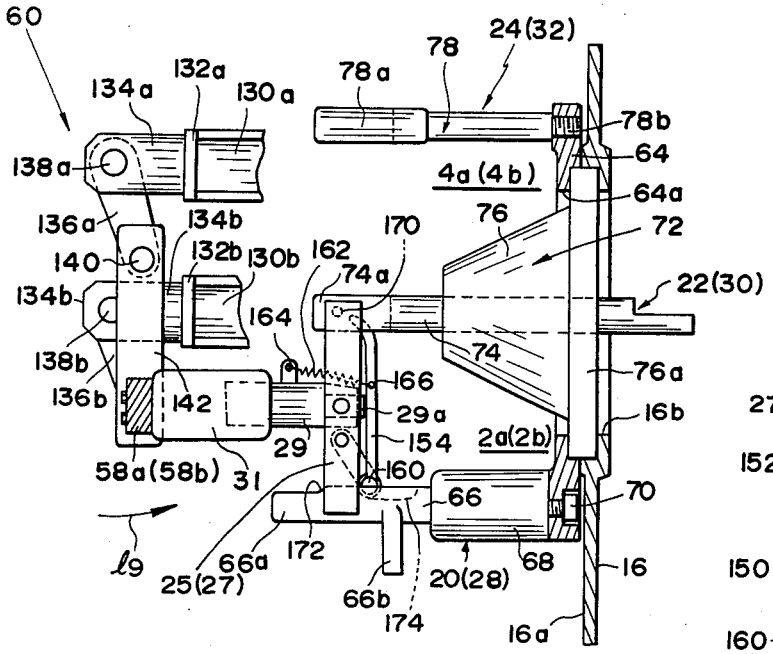
Figure 14:
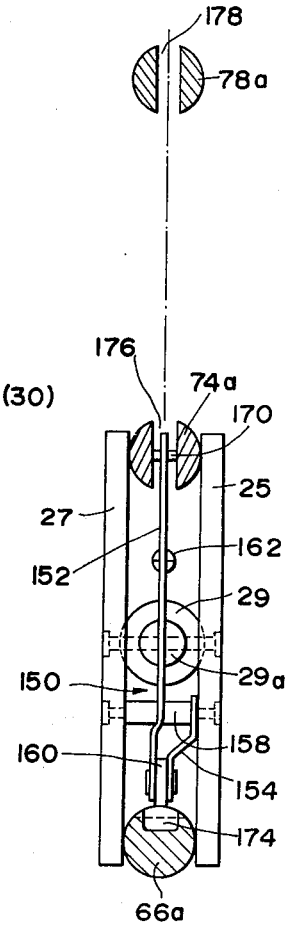

From the state of FIG. 10, when the common movable contact member 24*a* or 24*b* is moved back in the counter-clockwise direction, the common movable contact 25 or 27 contacts initially with the contacting portion 66*a* of the stationary contact member 20 or 28, as is shown in FIG. 11. Under the condition shown in FIG. 11, the roller 156 engages with the step of the recess 172 and the arcing contact 152 is pulled in the clockwise direction, and thereby the intermediate portion of the arcing contact 152 is pressed against a projecting portion 29*a* thereof. When the common movable contact member 26*a* or 26*b* moves through the semicircular path as indicated by arrow $l_7$, the movable contact blades 25 and 27 contact with the contact portion 74*a* of the conductor 74, as is shown in FIG. 12. As the common movable contact member 26*a* or 26*b* continues to move, when the end portion 152*a* of the arcing contact 152 hits on the stopping pin 170, the turning force in the counter-clockwise direction is applied to the arcing contact 152 and then the arcing contact 152 rotates in an anti-clockwise direction about its end portion 152*a*. By the rotation of the arcing contact 152, the roller 156 slides over the step of the recess 172 and thereafter drops into the recess 174 of the conductor 66. Immediately after the roller 156 drops into the recess 174, the roller 156 is engaged with the stepping portion of the recess 174 as is shown in FIG. 13. In the state shown in FIG. 13, the arcing contact 152 is pulled by a component force of the tension of the spring 162, and slides on the projecting end of the connecting rod 29. From the state shown in FIG. 13, when the common movable contact blades 25 and 27 are further moved in the direction shown by arrow $l_9$, the arcing contact 152 springs upward as seen in the diagram and thereafter its end portion 152*a* engages with the engaging pin 170 as shown in FIG. 7.

According to the above described modification of the present invention the movable contact members and actuating linkages including the arc prevention mechanism are shared between the disconnecting units and and the earthing or grounding units. Therefore it is possible to make a disconnecting switch arrangement according to the present invention which is of compact design and simple construction. Furthermore, the speed of disconnection of the contacts which would otherwise arc, is made very high, giving an arc prevention means of very high reliability. Therefore a simple and compact disconnecting switch arrangement for both connecting and disconnecting an excitation current and earthing or grounding equipment is provided by the present invention.

While the present invention has been described in terms of a preferred embodiment and a modification thereof this is not to be taken as limitative of the present invention as many additions and modifications thereto will be apparent to those skilled in the art but the invention is rather to be taken as defined by the appended claims.

It will be understood that each of the elements described above or two or more together, may also find a useful application in other types of high voltage disconnecting switch arrangements differing from the types described above.

While the invention has been illustrated and described as embodied in high voltage disconnecting switch arrangement with turnable common movable contact members, it is not intended to be limited to the details shown, since various modifications and structural changes may be made without departing in any way from the spirit of the present invention.

What is claimed is:

1. A disconnecting switch arrangement comprising, in combination, at least one disconnecting unit consisting of a stationary contact member secured on an inner wall of a tank and terminating in an electrical conductor, a common stationary contact member secured on said inner wall of the tank and positioned spaced apart a predetermined distance from said stationary contact member and connected to an electrical machine, and a common movable contact member for connecting said stationary contact member and said common stationary contact member, at least one earthing unit for grounding said electrical machine and comprises said common stationary contact member, an earthing contact member fastened to the inner wall of said tank and spaced apart a predetermined distance from the common stationary contact member so as to be in alignment with said stationary contact member of the disconnecting unit and the common stationary contact member and said common movable contact member, and an actuating unit for moving in a circular movement said common movable contact member so as to be alternately and electrically connected with and disconnected from between said stationary contact member and said common stationary contact member in the disconnecting unit and between said earthing contact member and the common stationary contact member in the earthing unit, said actuating unit comprising at least one operating rod for mounting said common movable contact member, a first supporting member for supporting rotatably said operating rod, a second supporting member spaced apart a given distance with respect to the disconnecting unit and the earthing unit from said first supporting member and for supporting said operating rod together with the first supporting member and a driving member for moving in a circular motion said operating rod.

2. A disconnecting switch arrangement as claimed in claim 1 comprising a first disconnecting unit provided in a tank and consisting of a first stationary contact member secured on an inner wall of said tank, a first common stationary contact member secured on said inner wall of the tank and spaced apart a predetermined distance from said first stationary contact member and a first common movable contact member for connecting said first stationary contact member and said first common stationary contact member, a first earthing unit including said first common stationary contact member, a first earthing contact member fastened to the inner wall of said tank spaced apart a predetermined distance from said first common stationary contact member so as to be in alignment with said first stationary contact member and said first common stationary contact member and said common movable contact member, a second disconnecting unit provided in said tank and consisting of a second stationary contact member secured on the inner wall of said tank, a second common stationary contact member fastened to said inner wall of the tank and spaced apart a given distance from said second stationary contact member and a second common movable contact member for connecting said second stationary contact member and said second common stationary contact member, a second earthing unit including said second common stationary contact member, a second earthing contact member fastened to the inner wall of said tank spaced apart a predetermined distance from said second common stationary contact member so as to be in alignment with said second stationary contact member and said second common stationary contact member and said second common movable contact member, and an actuating unit for actuating said first and second common movable contact members for moving in a circular movement, said actuating unit comprising a pair of operating rods for mounting said first and second operating rods, a pair of first supporting members each of which is pivotably connected by an actuating arm and spaced a predetermined distance from each and a pair of second supporting members each of which is spaced apart from each.

3. A disconnecting switch arrangement as claimed in claim 1 wherein said disconnecting unit comprises a stationary contact member secured on the inner wall of the tank and which includes an electrical conductor consisting of an elongated electric conductor of fixed length and having a contact portion, a common stationary contact member which comprises an insulated electrical conductor having a fixed length elongated electric conductor fastened to the inner wall of the tank and of which one end is formed with a contact portion and a common movable contact member consisting of two electric conductive plate spaced apart a given distance from each.

4. A disconnecting switch arrangement as claimed in claim 1 wherein said earthing unit includes an earthing contact member which comprises an earthed conductor fastened to the inner wall of the tank spaced apart a given distance from an electric conductor of the common stationary contact member and in alignment with said conductor of the common stationary contact member and said electric conductor of the stationary contact member.

5. A disconnecting switch arrangement as claimed in claim 1 wherein said actuating unit comprises a first supporting member including a support secured on the inner wall of the tank, a bearing bracket mounted on said support, a link pivotably connected to said bearing bracket, an actuating arm of driving means, pivotably engaged with said link, an operating rod fastened to said actuating arm, and a second supporting member including a pair of supports having bearing brackets, each of which is secured on the inner wall of the tank and spaced apart from each and a pair of levers pivotably connecting said bearing brackets and said operating rods.

6. A disconnecting switch arrangement as claimed in claim 5 wherein said driving means comprises an electric motor, a support secured on the inner wall of the tank, a driving shaft connected to a rotating shaft of said motor and rotatably attached by means of bearing means, a driving bevel gear connected to said driving shaft and a driven bevel gear meshed with said driving bevel gear of which rotating shaft connected to an actuating arm by way of a lever.

7. A disconnecting switch arrangement as claimed in claim 1 further comprising an arcing contact member for interrupting an arc current flowing in said disconnecting unit including an arcing contact accommodated in said common movable contact member, an arcing contact driving means for driving said arcing contact and a disconnection delay means for delaying an electric disconnection of said common contact member from at least one of the stationary contact member and the common stationary contact member.

8. A disconnecting switch arrangement as claimed in claim 7 wherein said arcing contact comprises a long and slender electric conductive plate, a link which connects the electric conductive plate to the common movable contact member, said arcing contact driving means includes a spring interposed between said electric conductive plate and said common movable contact member.

9. A disconnecting switch arrangement as claimed in claim 7 wherein said disconnection delaying means includes a roller engaged with the electric conductive plate and the link of said arcing contact, a recess for engaging with said roller and provided on the surface of an intermediate portion of an electric conductor of the stationary contact member which is longer than an electric conductor of the common stationary contact member.

10. A disconnecting switch arrangement as claimed in claim 9 wherein said disconnection delaying means further includes an axial recess provided on a contact portion of said conductor of the stationary contact member, an groove provided in a contact portion of an electric conductor of said common stationary contact member and an engaging pin embedded in the contact portion and for engaging with the electric conductive plate of the arcing contact.

* * * * *